US010026366B2

(12) United States Patent
Zhang

(10) Patent No.: US 10,026,366 B2
(45) Date of Patent: Jul. 17, 2018

(54) LIQUID CRYSTAL TV SET, AND METHOD AND APPARATUS FOR ADJUSTING BACKLIGHT DRIVING VOLTAGE THEREOF

(71) Applicant: HISENSE ELECTRIC CO., LTD., Qingdao (CN)

(72) Inventor: Yuxin Zhang, Qingdao (CN)

(73) Assignees: HISENSE ELECTRIC CO., LTD., Qingdao (CN); HISENSE USA CORPORATION, Suwanee, GA (US); HISENSE INTERNATIONAL CO., LTD., Qingdao (CN)

( * ) Notice: Subject to any disclaimer, the term of this patent is extended or adjusted under 35 U.S.C. 154(b) by 58 days.

(21) Appl. No.: 15/393,530

(22) Filed: Dec. 29, 2016

(65) Prior Publication Data

US 2017/0110062 A1 Apr. 20, 2017

(30) Foreign Application Priority Data

Aug. 29, 2016 (CN) ..... 2016 1 0752668

(51) Int. Cl.

*G09G 5/10* (2006.01)
*G09G 3/34* (2006.01)
*G09G 3/36* (2006.01)

(52) U.S. Cl.

CPC ..... *G09G 3/342* (2013.01); *G09G 3/3648* (2013.01); *G09G 3/3696* (2013.01); *G09G 2300/0819* (2013.01); *G09G 2310/08* (2013.01); *G09G 2320/0204* (2013.01); *G09G 2320/0252* (2013.01); *G09G 2320/0626* (2013.01)

(58) Field of Classification Search

CPC ..... G09G 3/34; G09G 3/3406; G09G 3/342; G09G 3/36; G09G 3/3648; G09G 3/3696; G09G 2300/0819; G09G 2310/08; G09G 2320/0204; G09G 2320/0252; G09G 2320/06; G09G 2320/0626; G09G 2320/0653

See application file for complete search history.

(56) References Cited

U.S. PATENT DOCUMENTS

2007/0257869 A1* 11/2007 Huang ..... G09G 3/3406 345/82
2009/0027327 A1* 1/2009 Urisu ..... G09G 3/3406 345/101

(Continued)

*Primary Examiner* — Joe H Cheng
(74) *Attorney, Agent, or Firm* — Harness, Dickey & Pierce, P.L.C.

(57) ABSTRACT

This disclosure relates to a liquid crystal TV set, and a method and apparatus for adjusting backlight driving voltage thereof, and the method for adjusting backlight driving voltage includes: comparing backlight driving current with reference driving current to obtain voltage feedback data, while a backlight source is being driven; making overvoltage adjustment to the voltage feedback data to generate overvoltage feedback data; and adjusting backlight driving voltage using the overvoltage feedback data to overvoltage-drive the backlight source by the adjusted backlight driving voltage. The liquid crystal TV set, and the method and apparatus for adjusting backlight driving voltage thereof according to this disclosure can improve the response speed of backlight in the liquid crystal TV set while the backlight source is being driven.

20 Claims, 10 Drawing Sheets

(56) References Cited

U.S. PATENT DOCUMENTS

| | | | | |
|---|---|---|---|---|
| 2010/0020108 | A1* | 1/2010 | Cho | G09G 3/3406 345/690 |
| 2010/0289424 | A1* | 11/2010 | Chang | H05B 33/0818 315/250 |
| 2011/0101885 | A1* | 5/2011 | Yang | G09G 3/3406 315/294 |
| 2013/0321254 | A1* | 12/2013 | Kim | G09G 3/36 345/102 |
| 2014/0184959 | A1* | 7/2014 | Zhang | H05B 33/0887 349/15 |
| 2015/0154917 | A1* | 6/2015 | Jung | H05B 33/0815 345/102 |
| 2015/0339967 | A1* | 11/2015 | Shin | G06F 3/1446 345/690 |
| 2016/0117997 | A1* | 4/2016 | Matsui | H05B 33/0845 345/691 |

* cited by examiner

LIQUID CRYSTAL TV SET, AND METHOD AND APPARATUS FOR ADJUSTING BACKLIGHT DRIVING VOLTAGE THEREOF

CROSS-REFERENCE TO RELATED APPLICATION

This application claims the benefit and priority of Chinese Patent Application No. 201610752668.0 filed Aug. 29, 2016. The entire disclosure of the above application is incorporated herein by reference.

FIELD

This disclosure relates to the field of liquid crystal TV sets, and particularly to a liquid crystal TV set, and a method and apparatus for adjusting backlight driving voltage thereof.

BACKGROUND

This section provides background information related to the present disclosure which is not necessarily prior art.

With the traditional schemes to control dynamic backlight, typically a DC/DC converter in a liquid crystal TV set generates backlight driving voltage to drive a backlight source, and also a feedback voltage or a feedback current is generated to the DC/DC converter in the liquid crystal TV set to adjust the backlight driving voltage output by the DC/DC converter so as to drive the backlight source to operate normally as a result.

SUMMARY

This section provides a general summary of the disclosure, and is not a comprehensive disclosure of its full scope or all of its features.

Some embodiments of this disclosure disclose a method for adjusting backlight driving voltage, the method including: comparing backlight driving current with reference driving current to obtain voltage feedback data, while a backlight source is being driven; making overvoltage adjustment to the voltage feedback data to generate overvoltage feedback data; and adjusting backlight driving voltage using the overvoltage feedback data to overvoltage-drive the backlight source by the adjusted backlight driving voltage.

Some embodiments of this disclosure further disclose an apparatus for adjusting backlight driving voltage, the apparatus including: a voltage feedback data obtaining unit configured to compare backlight driving current with reference driving current to obtain voltage feedback data, while a backlight source is being driven; an overvoltage feedback data generating unit configured to make overvoltage adjustment to the voltage feedback data to generate overvoltage feedback data; and an overvoltage adjusting unit configured to adjust backlight driving voltage using the overvoltage feedback data to overvoltage-drive the backlight source by the adjusted backlight driving voltage.

Some embodiments of this disclosure further disclose an apparatus for adjusting backlight driving voltage, the apparatus including: a memory configured to store at least one machine readable program code; and a processor configured to execute the at least one machine readable program code to perform: comparing backlight driving current with reference driving current to obtain voltage feedback data, while a backlight source is being driven; making overvoltage adjustment to the voltage feedback data to generate overvoltage feedback data; and adjusting backlight driving voltage using the overvoltage feedback data to overvoltage-drive the backlight source by the adjusted backlight driving voltage.

Some embodiments of this disclosure further disclose a liquid crystal TV set including an image processing apparatus and a backlight source, and further an apparatus for adjusting backlight driving voltage, wherein the image processing apparatus is configured to transmit generated backlight data to the apparatus for adjusting backlight driving voltage; and the apparatus for adjusting backlight driving voltage is configured to compare backlight driving current with reference driving current to obtain voltage feedback data, while a backlight source is being driven; to make overvoltage adjustment to the voltage feedback data to generate overvoltage feedback data; and to adjust backlight driving voltage using the overvoltage feedback data to overvoltage-drive the backlight source by the adjusted backlight driving voltage.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
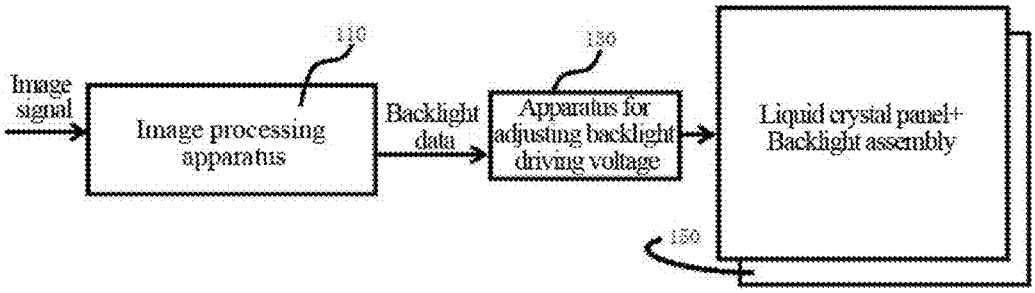
FIG. 2 is a block diagram of a liquid crystal TV set according to some embodiments of this disclosure.
Figure 3A:
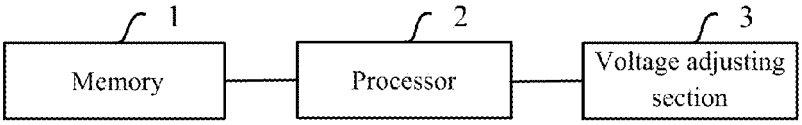
Figure 3B:
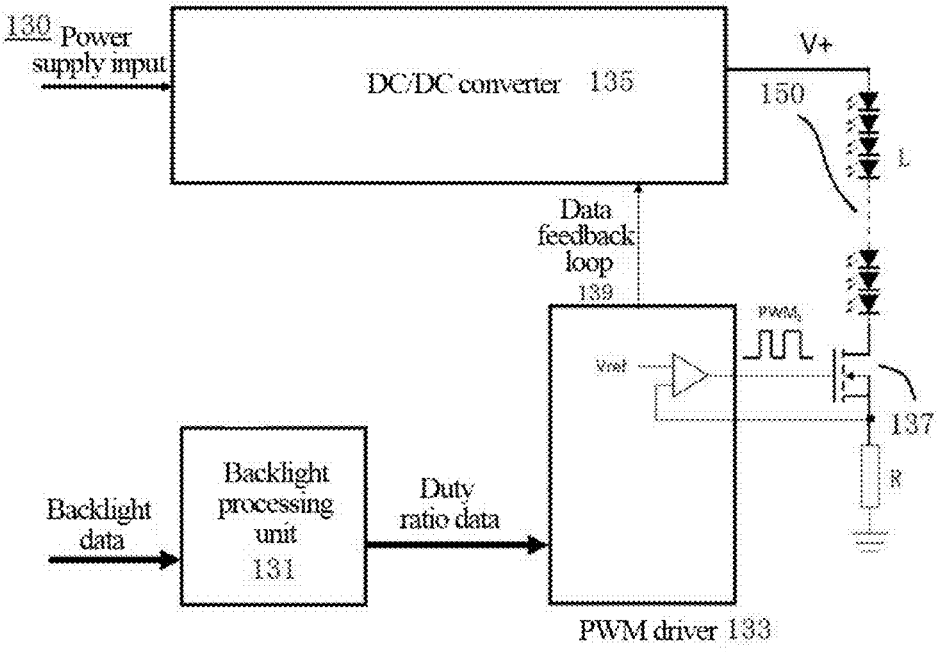

FIG. 3*a* is a block diagram of an embodiment of an apparatus for adjusting backlight driving voltage in the embodiments illustrated in FIG. 2;

FIG. 3*b* is a structural block diagram of an implementation of the apparatus illustrated in FIG. 3*a;*

Figure 4:
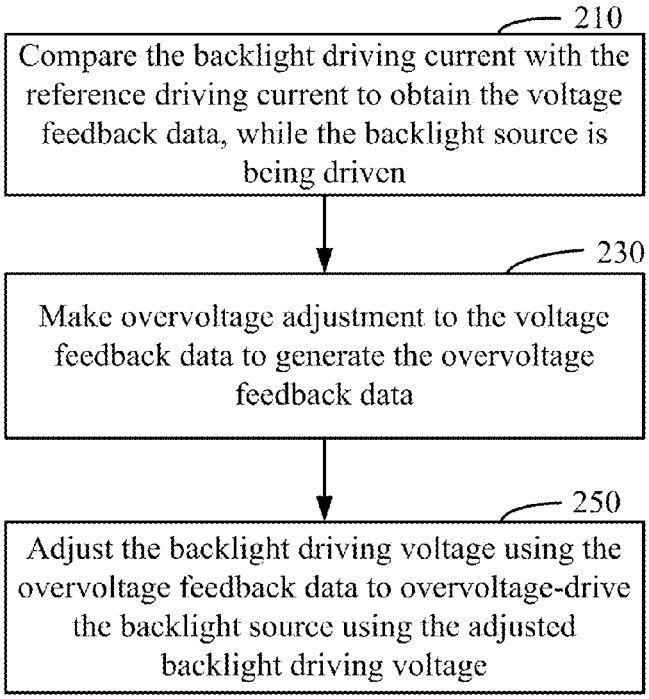
Figure 5:
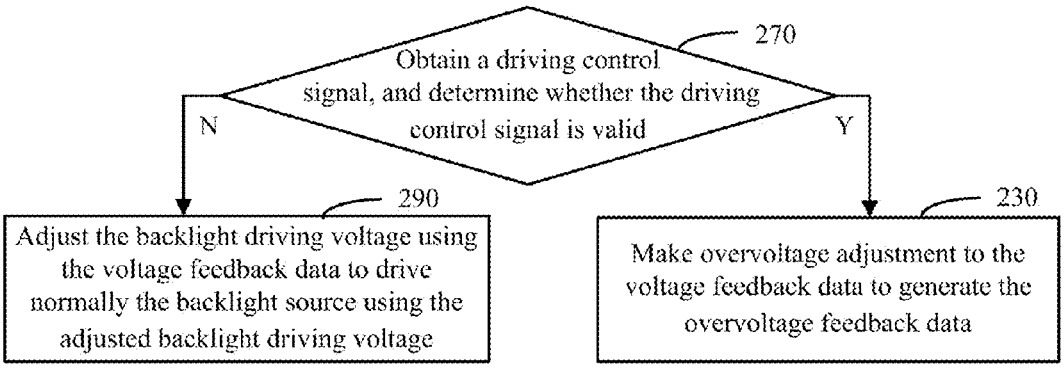
Figure 6:
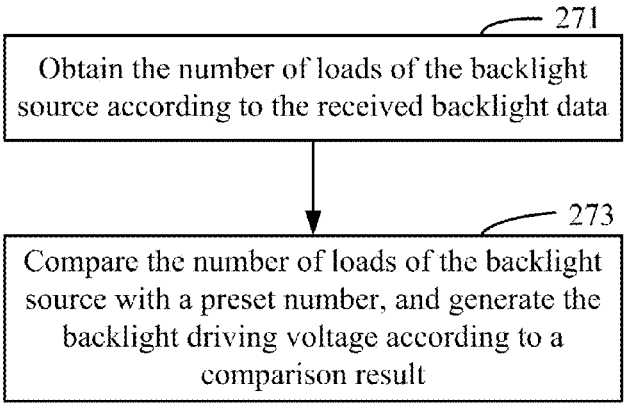
Figure 6A:
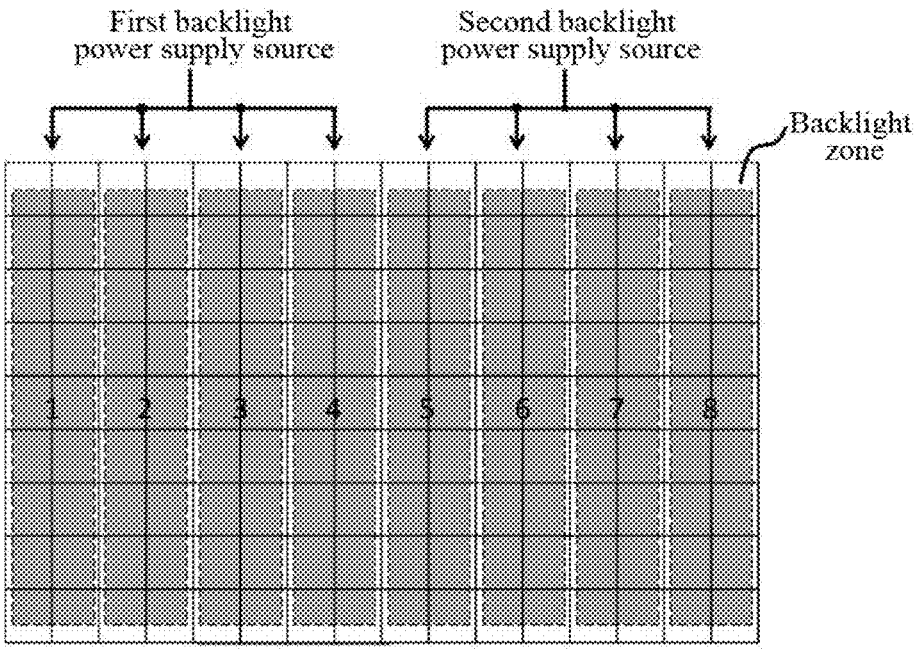
Figure 6B:
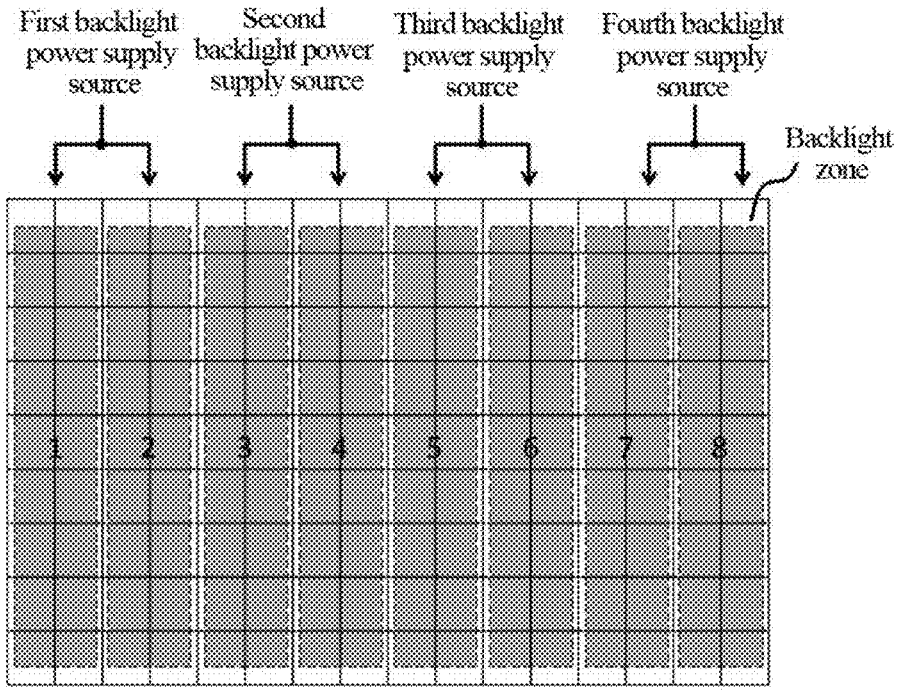
Figure 6C:
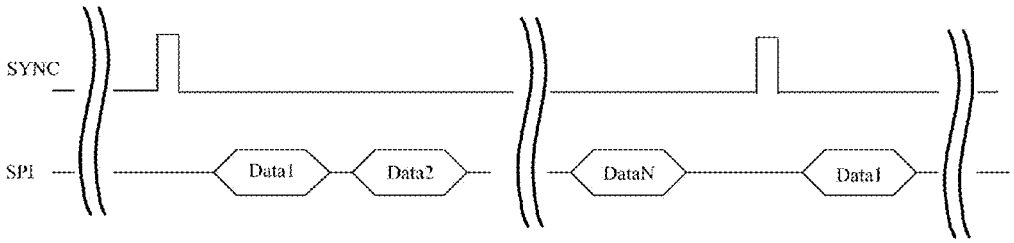
Figure 7:
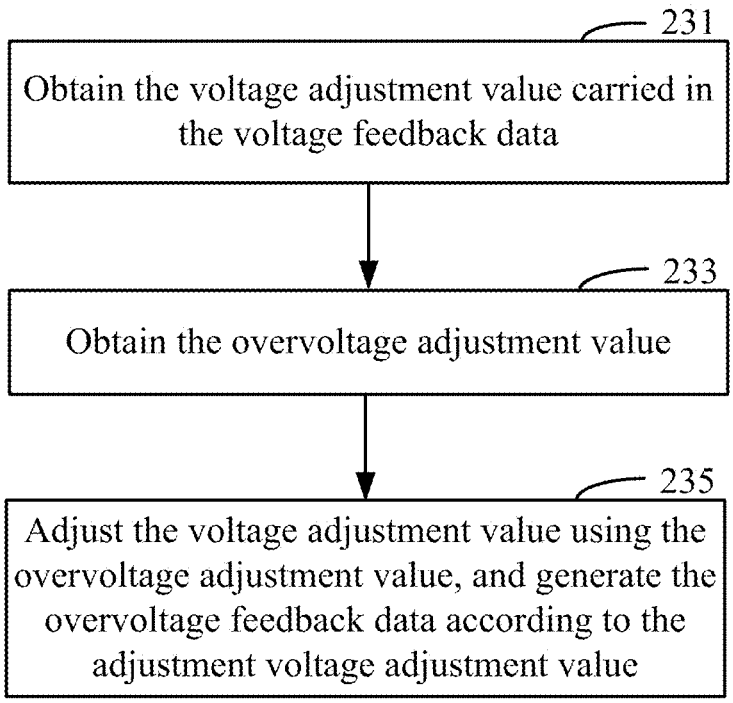
Figure 7A:
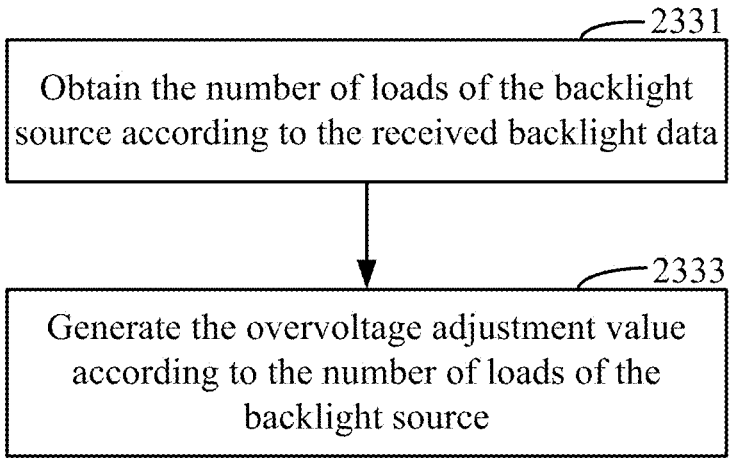
Figure 8:
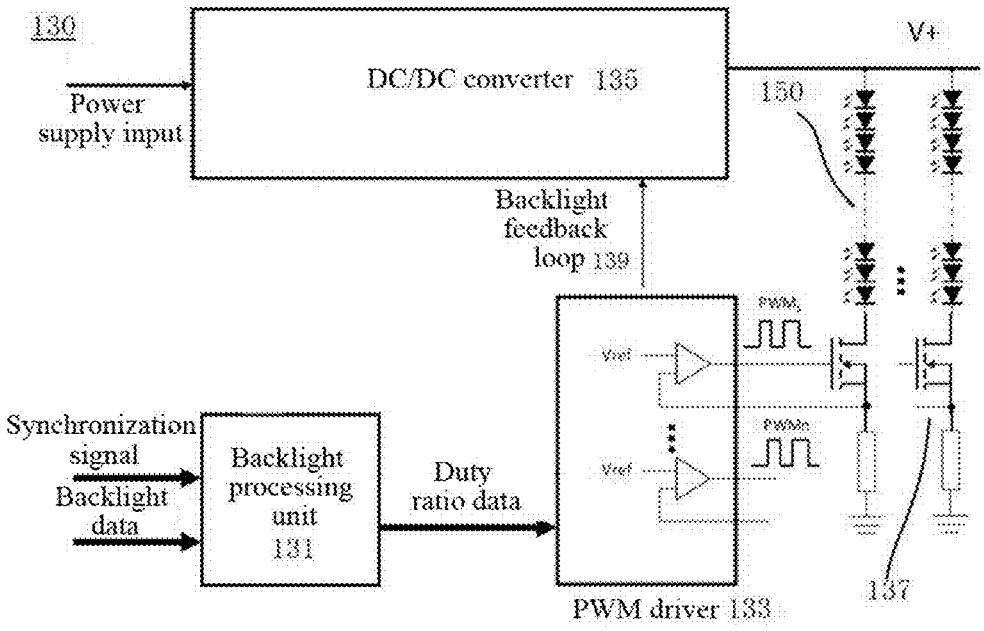
Figure 9:
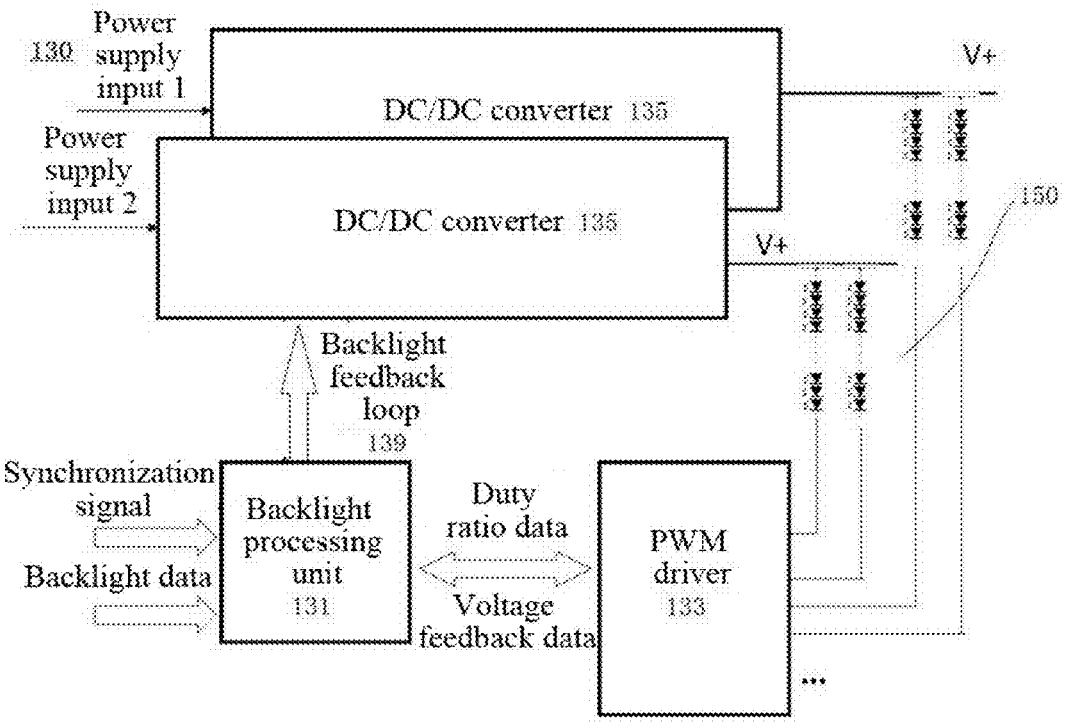
Figure 10:
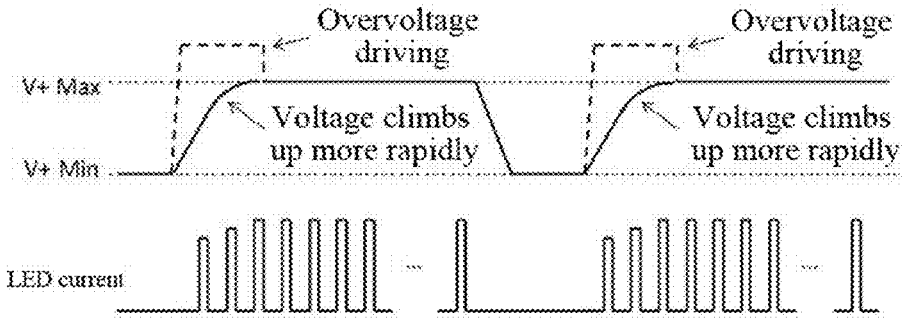
Figure 11:
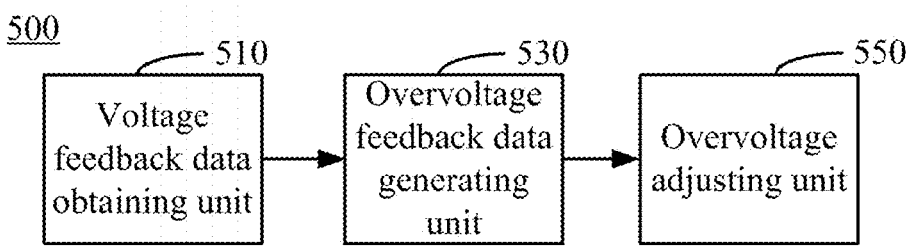
Figure 12:
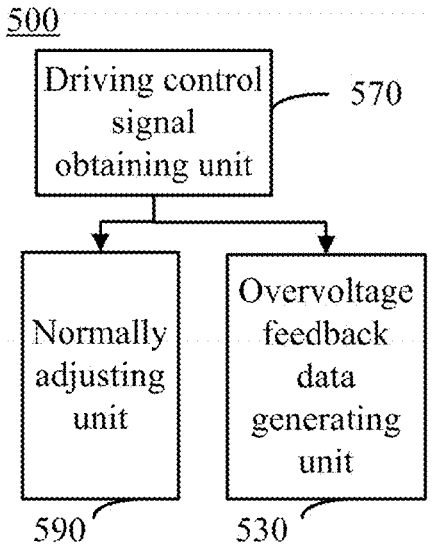
Figure 13:
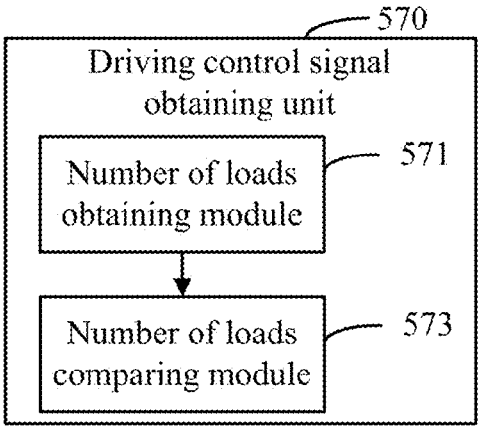
Figure 14:
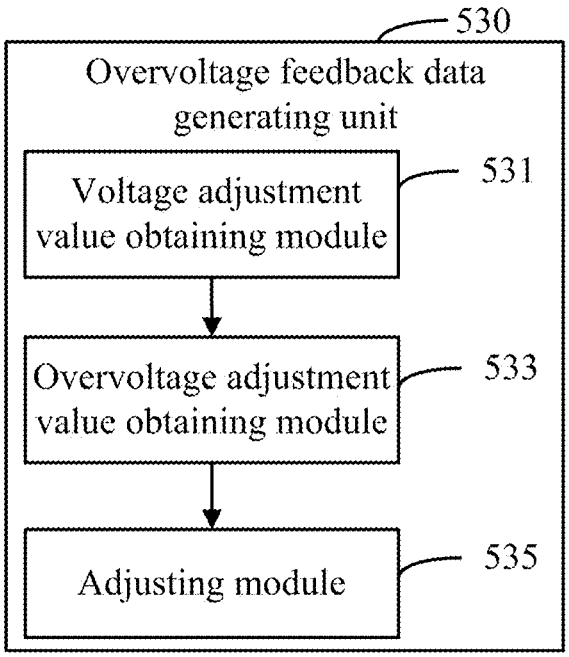
Figure 15:
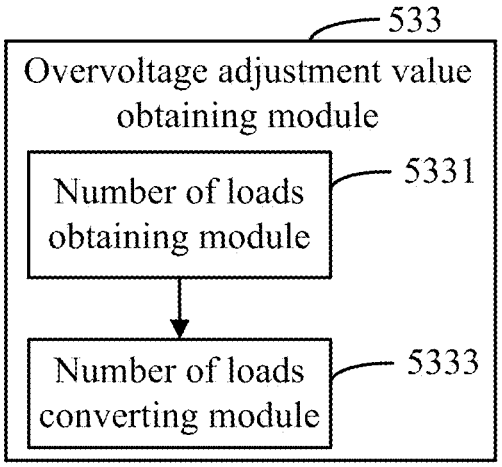

FIG. 4 is a flow chart of a method for adjusting backlight driving voltage according to some embodiments of this disclosure;

FIG. 5 is a flow chart of another method for adjusting backlight driving voltage according to some embodiments of this disclosure;

FIG. 6 is a flow chart of an embodiment of the step of obtaining a driving control signal in the embodiments illustrated in FIG. 4;

FIG. 6*a* is a first schematic diagram of allocating backlight power supply zones according to some embodiments of this disclosure;

FIG. 6*b* is a second schematic diagram of allocating backlight power supply zones according to some embodiments of this disclosure;

FIG. 6*c* is a schematic diagram of a synchronization signal according to some embodiments of this disclosure;

FIG. 7 is a flow chart of an embodiment of the step of making overvoltage adjustment to voltage feedback data, obtained by comparing backlight driving current with reference driving current, to generate overvoltage feedback data in the embodiments illustrated in FIG. 4;

FIG. 7*a* is a flow chart of an embodiment of the step of obtaining an overvoltage adjustment value in the embodiments illustrated in FIG. 7;

FIG. 8 is a schematic diagram of an implementation of the method for adjusting backlight driving voltage in an application scenario;

FIG. 9 is a schematic diagram of an implementation of the method for adjusting backlight driving voltage in another application scenario;

FIG. 10 is a schematic diagram of backlight driving voltage and LED current varying while a backlight is being driven according to some embodiments of this disclosure;

FIG. 11 is a block diagram of an apparatus for adjusting backlight driving voltage according to some embodiments of this disclosure;

FIG. 12 is a block diagram of another apparatus for adjusting backlight driving voltage according to some embodiments of this disclosure;

FIG. 13 is a block diagram of an embodiment of a driving control signal obtaining unit in the embodiments illustrated in FIG. 11;

FIG. 14 is a block diagram of an embodiment of an overvoltage feedback data generating unit in the embodiments illustrated in FIG. 11; and FIG. 15 is a block diagram of an embodiment in an overvoltage adjustment value obtaining module in the embodiments illustrated in FIG. 11.

Corresponding reference numerals indicate corresponding parts or features throughout the several views of the drawings.

DETAILED DESCRIPTION

Example embodiments will now be described more fully with reference to the accompanying drawings.

Various exemplary embodiments of the disclosure, examples of which are illustrated in the drawings, will be described below in details. The following description will be given with reference to the drawings throughout which like reference numerals refer to like or similar elements unless stated otherwise. The exemplary embodiments described below will not represent all the embodiments of this disclosure. On the contrary, they will be presented only as examples of a method and apparatus for adjusting backlight driving voltage according to some aspects of this disclosure as detailed in the appended claims.

Figure 1:
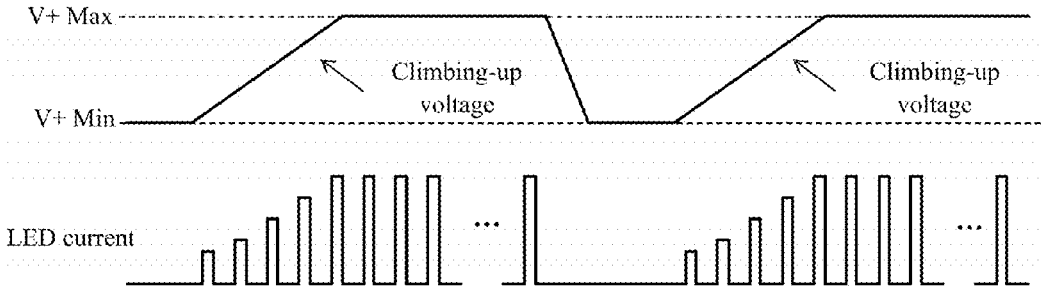
FIG. 1 is a schematic diagram of the backlight driving voltage and LED current varying while the backlight source is being driven in the related art.

In the related art, while the backlight source is being driven, load power of the backlight source is growing with a gradually increasing number of backlight lamps in the backlight source, so that the DC/DC converter needs to output higher backlight driving voltage to drive the backlight source. Since it is impossible for the DC/DC converter to adjust rapidly the backlight driving voltage from lower voltage to higher voltage, that is, the backlight driving voltage climbs up still gently, as illustrated in FIG. 1, there is such a low response speed of the backlight of the liquid crystal TV set that the backlight source cannot be driven and adjusted in brightness rapidly, so that the backlight may become brighter and darker slowly, thus degrading the visual effect thereof as a whole.

Accordingly there remains such a problem in the existing method for adjusting backlight driving voltage that there is a low response speed of the backlight in the liquid crystal TV set while the backlight source is being driven.

In view of this, this disclosure provides such a technical solution that while a backlight source is being driven, voltage feedback data are obtained, overvoltage adjustment is made to the voltage feedback data to generate overvoltage feedback data, backlight driving voltage is adjusted according to the overvoltage feedback data, and further the backlight source is overvoltage-driven by the adjusted backlight driving voltage, where the voltage feedback data are generated by comparing backlight driving current with reference driving current.

Stated otherwise, while the backlight source is being driven, overvoltage adjustment is made to the backlight driving voltage, that is, the backlight driving voltage to drive the backlight source is obtained as a result of adjustment using the overvoltage feedback data instead of the voltage feedback data, thus speeding up dynamic adjustment to the backlight driving voltage, so that the backlight driving voltage can be adjusted rapidly from lower voltage to higher voltage, thus improving the response speed of the backlight in the liquid crystal TV set to thereby drive rapidly the backlight source.

FIG. 2 is block diagram of a liquid crystal TV set according to an embodiment of this disclosure, and as illustrated in FIG. 2, the liquid crystal TV set 100 includes an image processing apparatus 110, an apparatus 130 for adjusting backlight driving voltage, and a backlight source 150, where:

The image processing apparatus 110 is configured to generate backlight data according to an input image signal.

The apparatus 130 for adjusting backlight driving voltage is configured to receive the backlight data output by the image processing apparatus 110, and to further adjust dynamically backlight driving voltage using internally generated voltage feedback data.

The backlight source 150 is configured to receive the backlight driving voltage output by the apparatus 130 for adjusting backlight driving voltage, and to be driven normally by the backlight driving voltage, so that the backlight source 150 operates normally at startup voltage as a result.

It shall be noted that both the backlight driving voltage and the startup voltage is referred to as power supply voltage of the backlight source 150 except that while the backlight source 150 is being driven, the backlight source 150 is driven by the backlight driving voltage, and when the backlight source 150 is driven by the backlight driving voltage to operate normally as a result, the backlight driving voltage at that time is the startup voltage.

It shall be noted that the liquid crystal TV set 100 is only an example to which this disclosure is applicable, but shall not be construed as any limitation on the scope of this disclosure. The liquid crystal TV set 100 shall not be construed as any required dependence upon or inclusion of one or more components in the exemplary liquid crystal TV set 100 illustrated in FIG. 2.

FIG. 3*a* is a block diagram of an embodiment of the apparatus 130 for adjusting backlight driving voltage in the embodiment illustrated in FIG. 2. The apparatus 130 for adjusting backlight driving voltage can include a memory 1, a processor 2, and a voltage adjusting section 3, where the memory is configured to store at least one machine readable code; the processor 2 is configured to execute the at least one machine readable code to perform related functions, for example, while the backlight source is being driven, to compare the backlight driving current with the reference driving current to obtain the voltage feedback data, and to make overvoltage adjustment to the voltage feedback data to generate the overvoltage feedback data; and the voltage adjusting section 3 is configured to adjust the backlight driving voltage using the overvoltage feedback data from the processor to overvoltage-driven the backlight source by the adjusted backlight driving voltage.

FIG. 3*b* illustrates a structure of an implementation of the apparatus illustrated in FIG. 3*a*, and as illustrated in FIG. 3*b*, the apparatus 130 for adjusting backlight driving voltage includes a backlight processing unit 131, a PWM driver 133, and a DC/DC converter 135. In an implementation, as illustrated in FIG. 3*b*, the backlight processing unit 131 can include a memory 1, and a processor 2 which can be a Micro Control Unit (MCU). The voltage adjusting section 3 includes a PWM driver 133 and a DC/DC converter 135, where the PWM driver 133 includes at least one PWM driving chip.

Here the backlight processing unit 131 has an input configured to receive backlight data, and an output connected with an input of the PWM driver 133, the PWM driver 133 has one output connected with a feedback input of the DC/DC converter 135 through a data feedback loop 139, and the DC/DC converter 135 has a voltage input configured to has a backlight power supply source input thereto, and a voltage output configured to output the backlight driving voltage V+ to drive the backlight source 150.

Furthermore the backlight source 150 includes a number of backlight lamps L, which are connected in series, where the backlight lamps L are Light Emitting Diodes (LEDs). The backlight source 150 has one end (the anode of a light emitting diode) connected with the voltage output of the DC/DC converter 135, and the other end (the cathode of a light emitting diode) connected with the ground through a switch element 137.

Furthermore the switch element 137 is preferably a field effect transistor with a gate connected with the other output of the PWM driver 133, a drain connected with the other end of the backlight source 150 (the cathode of the light emitting diode), and a source connected with the ground through a sample resistor R.

It shall be noted that in another embodiment, the DC/DC converter 135 can alternatively be an AC/DC converter, and the switch element 137 can alternatively be another element capable of be switched on/off, but the respective embodiments of this disclosure will not be limited thereto.

Now the method for adjusting backlight driving voltage in the related art will be described below with reference to FIG. 2 and FIG. 3*b*.

The backlight processing unit 131 receives the backlight data output by the image processing apparatus 110, and then maps the backlight data into duty ratio data.

Here the duty ratio data represents the temporal ratio of a valid level in a cycle to control the brightness of the backlight source. If the backlight data are larger, then the duty ratio data will be larger, and accordingly the brightness of the backlight source will be higher. The range of the value of the duty ratio data is dependent upon a PWM driving chip, for example, if the PWM driving chip operates with 12 bits, then the range of the value of the duty ratio data will be 0 to 212−1, that is, the backlight data will be mapped into 0 to 4095.

The PWM driver 133 receives the duty ratio data output by the backlight processing unit 131, and then modulates a pulse width according to the duty ratio data to generate a pulse width modulation signal PWM1, and controls the filed effect transistor to be switched on/off, using the pulse width modulation signal PWM1 to thereby drive, and adjust the brightness of, the backlight source 150.

If the pulse width modulation signal PWM1 is at a low level, then the filed effect transistor will be switched off, and at this time, the backlight driving voltage will not be adjusted dynamically, and the backlight lamps L connected in series in the backlight source 150 will remain inactive.

If the pulse width modulation signal PWM1 is at a high level, then the filed effect transistor will be switched on, and at this time, the backlight lamps L connected in series in the backlight source 150 will be driven by the backlight driving voltage, thus resulting in such backlight driving current in the series circuit that also flows through the sample resistor R.

On the other hand, a reference driving voltage Vref is set in the PWM driver 133, and the reference driving current is obtained as Vref/R, and input to one input of a comparator and amplifier arranged in the PWM driver 133. The other input of the comparator and amplifier is connected with the source of the filed effect transistor, so that if the filed effect transistor is switched on, then the backlight driving current will be input to the other input of the comparator and amplifier.

Here the reference driving voltage Vref can be calculated from the backlight data through voltage conversion, or can be preset when the liquid crystal TV set is powered on.

Furthermore if the backlight driving current fails to satisfy the reference driving current (e.g., the backlight driving current is higher or lower than the reference driving current), then the PWM driver 133 will generate the voltage feedback data through the comparator and amplifier comparing the backlight driving current with the reference driving current, and transmit the voltage feedback data to the feedback input of the DC/DC converter 135 through the data feedback loop 139, so that the DC/DC converter 135 adjusts the backlight driving voltage using the voltage feedback data, and further outputs the adjusted backlight driving voltage V+ to drive normally the backlight source 150.

As can be appreciated, as long as the backlight driving current fails to satisfy the reference driving current, if the pulse width modulation signal $PWM_1$ is at a high level, then the backlight driving voltage will be adjusted constantly in the feedback mode described above, so that the backlight driving current adjusted according to the backlight driving voltage is gradually approaching the reference driving current. If the backlight driving current satisfies the reference driving current, then driving of the backlight 150 will be finished, that is, the backlight source 150 will operate normally at the startup voltage, and the backlight lamps L connected in series in the backlight source 150 will be activated.

Still furthermore, after the backlight lamps L connected in series in the backlight source 150 are activated, the brightness of the backlight source 150 is adjusted using the duty ratio data. If the duty ratio data are larger, than the pulse width modulation signal PWM1 will remain at a high level for a longer period of time, and accordingly the field effect transistor will remain switched on for a longer period of time, so that the backlight driving current will flow through the series circuit for a longer period of time, that is, the backlight lamps L will remain lightened for a longer period of time, so the brightness of the backlight source 150 will also be higher.

As can be apparent from the disclosure above, while the backlight source 150 is being driven, that is, the backlight lamps L connected in series in the backlight source 150 are being activated from the inactive state, if there are a large number of backlight lamps L connected in series in the backlight source 150, then since the total voltage of the series circuit is the sum of the voltage of the respective elements which are connected in series, the DC/DC converter 135 will output such higher backlight driving voltage that all the backlight lamps L can be activated.

Since the backlight driving voltage is gradually adjusted in the feedback mode described above, that is, the DC/DC converter 135 adjusts dynamically the backlight driving voltage slowly, the backlight driving voltage cannot be adjusted rapidly from lower voltage to higher voltage, so there is such a low response speed of the backlight of the liquid crystal TV set that the backlight source cannot be driven and adjusted in brightness rapidly, so that the backlight may become brighter and darker slowly, thus degrading the visual effect thereof as a whole.

In view of this, in order to improve the response speed of the backlight of the liquid crystal TV set, there is proposed a method for adjusting backlight driving voltage.

Now the method for adjusting backlight driving voltage, applicable to the liquid crystal 100 illustrated in FIG. 2 will be described below in details with reference to FIG. 2 to FIG. 3*b*.

Referring to FIG. 4, the method for adjusting backlight driving voltage according to an embodiment can be performed by the apparatus 130 for adjusting backlight driving voltage in the liquid crystal TV set in the following steps:

The step 210 is to compare the backlight driving current with the reference driving current to obtain the voltage feedback data, while the backlight source is being driven.

As described above, the PWM driver 133 receives the duty ratio data output by the backlight processing unit 131, and then modulates the pulse width according to the duty ratio data to generate the pulse width modulation signal PWM1.

If the pulse width modulation signal PWM1 is at a high level, then the filed effect transistor will be switched on, and at this time, the backlight lamps L connected in series in the backlight source 150 will be driven by the backlight driving voltage, thus resulting in such backlight driving current in the series circuit that also flows through the sample resistor R.

On the other hand, a reference driving voltage Vref is set in the PWM driver 133, and the reference driving current is obtained as Vref/R, and input to one input of a comparator and amplifier arranged in the PWM driver 133. The other input of the comparator and amplifier is connected with the source of the filed effect transistor, so that if the filed effect transistor is switched on, then the backlight driving current will be input to the other input of the comparator and amplifier.

Furthermore if the backlight driving current fails to satisfy the reference driving current (e.g., the backlight driving current is higher or lower than the reference driving current), then the PWM driver 133 will generate the voltage feedback data through the comparator and amplifier comparing the backlight driving current with the reference driving current, so that the backlight driving current subsequently approaches the reference driving current according to the voltage feedback data.

The step 230 is to make overvoltage adjustment to the voltage feedback data to generate the overvoltage feedback data.

Here the voltage feedback data are generated in the PWM driver 133, and the overvoltage feedback data are generated in the backlight processing unit 131. There is a channel, over which the feedback data are transmitted, arranged between the backlight processing unit 131 and the PWM driver 133, so that the backlight processing unit 131 can receive the voltage feedback data transmitted by the PWM driver 133, and the PWM driver 133 can also receive the overvoltage feedback data transmitted by the backlight processing unit 131.

Both the voltage feedback data and the overvoltage feedback data carry such voltage adjustment values that the DC/DC converter 135 can adjust the output backlight driving voltage V+ according to the voltage adjustment values after obtaining the voltage adjustment values.

The over-voltage adjustment refers to that the voltage adjustment value carried in the generated overvoltage feedback data is more than the voltage adjustment value carried in the voltage feedback data, so that the backlight driving voltage which has been adjusted using the overvoltage feedback data is higher than the backlight driving voltage which has been adjusted using the voltage feedback data, thus speeding up dynamic adjustment to the backlight driving voltage, so that the backlight driving voltage can be adjusted rapidly from lower voltage to higher voltage, thus improving the response speed of the backlight in the liquid crystal TV set to thereby rapidly drive, and adjust the brightness of, the backlight source 150.

For example, the overvoltage adjustment can be made through additional compensation using the voltage feedback data, that is, the voltage adjustment value carried in the voltage feedback data is processed using a compensation value to thereby obtain the voltage feedback data carrying the processed voltage adjustment value, where the compensation value can be added to the voltage adjustment value, or the voltage adjustment value can be multiplied with the compensation value.

Furthermore the compensation value can be preset by the backlight processing unit 131, or can be generated dynamically by the backlight processing unit 131, for example, the backlight processing unit 131 processes the received backlight data, and obtains the overvoltage adjustment value, so that if the backlight data are larger, than the compensation value will be larger.

It shall be noted that the output backlight driving voltage can alternatively be adjusted dynamically using a current adjustment value in the DC/DC converter 135, so the voltage feedback data and the overvoltage feedback data can alternatively carry current adjustment values in different application scenarios to thereby improve the general applicability of the apparatus 130 for adjusting backlight driving voltage.

The step 250 is to adjust the backlight driving voltage using the overvoltage feedback data to overvoltage-drive the backlight source using the adjusted backlight driving voltage.

After the overvoltage feedback data are generated, the overvoltage feedback data are transmitted, so that the DC/DC converter 135 receives the overvoltage feedback data.

Here the overvoltage feedback data can be fed by the backlight processing unit 131 back directly to the DC/DC converter 135, or can be firstly transmitted to the PWM driver 133, and then forwarded by the PWM driver 133 to the DC/DC converter 135 through the data feedback loop 139.

The DC/DC converter 135 receiving the overvoltage feedback data can adjust the backlight driving voltage using the overvoltage feedback data, so that the backlight source 150 is overvoltage-driven by the backlight driving voltage higher than normal backlight driving voltage (typically obtained as a result of adjustment using the voltage feedback data), so that the backlight source 150 is driven and adjusted in brightness rapidly.

With the process as described above, the response speed of the backlight in the liquid crystal TV set can be improved to thereby avoid such a problem in the related art that the backlight driving voltage cannot be adjusted rapidly while the backlight source is being driven, thus varying the brightness of the backlight slowly, and consequently degrading the visual effect as a whole.

Referring to FIG. 5, the method as described above according to an embodiment of this disclosure can further include the following steps which can be performed by the backlight processing unit 131 in the apparatus 130 for adjusting backlight driving voltage:

The step 270 is to obtain a driving control signal, and to determine whether the driving control signal is valid.

As described above, there is a slow response speed of the backlight in the liquid crystal TV set because the DC/DC converter needs to output higher backlight driving voltage to drive the backlight source, but the backlight driving voltage cannot be adjusted rapidly from lower voltage to higher voltage.

In view of this, a driving control signal is set in this embodiment to indicate whether the DC/DC converter 135 needs to output higher backlight driving voltage to drive the backlight source, while the backlight source is being driven.

The driving control signal can be preset by the backlight processing unit 131, for example, the backlight processing unit 131 can set the driving control signal always valid to indicate that the backlight driving voltage needs to be adjusted rapidly while the backlight source is being driven.

The driving control signal can alternatively be generated dynamically by the backlight processing unit 131, for example, the backlight processing unit 131 obtains the driving control signal from the received backlight data so that if the backlight data are above a preset threshold, then the driving control signal will be valid, where the backlight driving voltage needs to be adjusted rapidly only if the back data are above the preset threshold, while the backlight source is being driven.

Furthermore the driving control signal can be stored in a register or a memory in the backlight processing unit 131, so that the driving control signal can be retrieved from the register or the memory.

After the driving control signal is obtained, the backlight processing unit 131 can determine whether to make overvoltage adjustment to the voltage feedback data, according to the validity of the driving control signal, and further overvoltage-drive the backlight source using the overvoltage-adjusted backlight driving voltage.

If the driving control signal is valid, then it will indicate that the DC/DC converter 135 needs to output higher backlight driving voltage to drive the backlight source, that is, the backlight driving voltage needs to be adjusted rapidly. Accordingly the process proceeds to the step 230 where overvoltage adjustment is made to the voltage feedback data to generate the overvoltage feedback data, so that the DC/DC converter 135 can output higher backlight driving voltage according to the overvoltage feedback data.

On the contrary, if the driving control signal is invalid, then it will indicate that the DC/DC converter 135 does not need to output higher backlight driving voltage to drive the backlight source, that is, the backlight driving voltage does not need to be adjusted rapidly. Accordingly the process proceeds to the step 290 where no overvoltage adjustment is made to the voltage feedback data, but the voltage feedback data is transmitted directly to the DC/DC converter 135, so that the DC/DC converter 135 adjusts the backlight driving voltage using the voltage feedback data to drive normally the backlight source 150 using the adjusted backlight driving voltage.

The step 290 is to adjust the backlight driving voltage using the voltage feedback data to drive normally the backlight source using the adjusted backlight driving voltage.

With the process as described above, only if the driving control signal is valid, overvoltage adjustment will be made to the voltage feedback data, and if the driving control signal is invalid, the backlight driving voltage will be adjusted normally using the voltage feedback data directly, thus shortening in effect the period of time for adjusting the backlight driving voltage to thereby improve the efficiency of adjusting and driving the backlight driving voltage.

Furthermore referring to FIG. 6, the step 270 in an embodiment of this disclosure can be performed by the backlight processing unit 131 in the apparatus 130 for adjusting backlight driving voltage, and include the following steps:

The step 271 is to obtain the number of loads of the backlight source according to the received backlight data.

It shall be appreciated that a display section of the liquid crystal TV set 100 includes a liquid crystal panel and a backlight source 150, where the liquid crystal panel itself does not emit any light, but the backlight source 150 has the backlight lamps L therein switched on or off according to the brightness of the image signal, so that light rays produced by the backlight lamps L illuminate the liquid crystal panel from the sides or backside thereof to thereby enable the liquid crystal panel to display at some brightness.

In this way, in this embodiment, the backlight data are characterized by the brightness value of the image signal, and accordingly the backlight data are configured to control the backlight source 150 to product the brightness agreeing with the image signal. The backlight data are received so that the backlight source 150 is subsequently driven at the brightness agreeing with the image signal, so the brightness of the backlight source 150 satisfies the required brightness of the image signal.

As described above, the backlight data are generated by the image processing apparatus 110 of the liquid crystal TV set 100. Such a backlight data extracting unit is arranged in the image processing apparatus 110 that is configured to calculate the brightness according to the input image signal to thereby generate the backlight data. If the brightness of the image signal is higher, than the calculated backlight data will be larger.

After the image processing apparatus 110 transmits the generated backlight data, the apparatus 130 for adjusting backlight driving voltage can receive the backlight data.

Furthermore as described above, while the backlight source 150 is being driven, the load power of the backlight source 150 is growing with a gradually increasing number of loads of the backlight source 150, so that the DC/DC converter 135 needs to output higher backlight driving voltage to drive the backlight source 150.

Accordingly in this embodiment, before the DC/DC converter 135 outputs higher backlight driving voltage, the backlight processing unit 131 firstly determines whether there are a too large number of loads of the backlight source 150, that is, only if there are a too large number of loads of the backlight source 150, then the DC/DC converter 135 will output higher backlight driving voltage.

Furthermore since the backlight data are configured to control the backlight source 150 to produce the brightness agreeing with the image signal, it can reflect the brightness of the backlight source 150, where the limited brightness of each backlight lamp L is dependent upon rated power of the backlight lamp L. If the backlight data are very large, which indicates that the brightness of the backlight source 150 is very high, then the demand for the very high brightness of the backlight source 150 will need to be satisfied by increasing the number of backlight lamps L in the backlight source 150, for example, increasing the number of backlight lamps L connected in series as illustrated in FIG. 3.

Accordingly in this embodiment, the number of loads of the backlight source 150 will be calculated according to the backlight data.

The current brightness of the backlight source 150 is calculated from the backlight data, and the number of backlight lamps L corresponding to the current brightness, i.e., the number of loads of the backlight source 150, is calculated according to real brightness of each backlight lamp L, where the real brightness of the backlight lamp L is dependent upon the resistance of the backlight lamp L, and the reference driving current.

The step 273 is to compare the number of loads of the backlight source with a preset number, and to generate the backlight driving voltage according to a comparison result.

After the number of loads of the backlight source 150 is obtained, it can be determined whether there are a too large number of loads of the backlight source 150, by comparing the number of loads of the backlight source 150 with the preset number, and it can be further determined whether the DC/DC converter 135 needs to output higher backlight driving voltage.

If the number of loads of the backlight source 150 is more than the preset number, then the comparison result will show that the number of loads of the backlight source 150 is too large, and accordingly the driving control signal generated according to the comparison result will be high-valid, so it is determined that the DC/DC converter 135 needs to output higher backlight driving voltage, and further the backlight processing unit 131 makes overvoltage adjustment to the voltage feedback data using the high-valid driving control signal, so that the DC/DC converter 135 overvoltage-drives the backlight source 150 by the backlight driving voltage adjusted using the overvoltage feedback data.

On the contrary, if the number of loads of the backlight source 150 is no more than the preset number, then the comparison result will show that the number of loads of the backlight source 150 is limited, and accordingly the driving control signal generated according to the comparison result will be low-valid, so it is determined that the DC/DC converter 135 does not need to output higher backlight driving voltage, and further the DC/DC converter 135 drives normally the backlight source 150 directly by the backlight driving voltage adjusted using the voltage feedback data.

Of course, the driving control signal can alternatively be low-valid to indicate that the apparatus 130 for adjusting backlight driving voltage needs to overvoltage-drive the backlight source 150, but this embodiment will not be limited thereto.

After the driving control signal is generated, the backlight processing unit 131 can obtain the driving control signal.

For example, if the driving control signal is generated and stored in a register of the backlight processing unit 131, then the backlight processing unit 131 will retrieve the driving control signal from the register.

With the process as described above, if there are a limited number of loads of the backlight source, then overvoltage adjustment will not be made to the voltage feedback data to thereby shorten the period of time for adjusting dynamically the backlight driving voltage to thereby improve the efficiency of adjusting and driving the backlight driving voltage.

In an embodiment of this disclosure, the method as described above can further include the following step which can be performed by the backlight processing unit 131 in the apparatus 130 for adjusting backlight driving voltage:

The backlight data are zoned into a plurality of pieces of zone backlight data according to a distribution condition of backlight power supply zones.

The backlight source can be powered by one backlight power supply source, that is, the backlight power supply source powers the same backlight area where the backlight source is located. However typically in order to alleviate a powering overload of the backlight power supply source, the backlight source can alternatively be powered by a plurality of backlight power supply sources, that is, each backlight power supply source powers only one backlight power supply zones in the backlight area.

For example, the backlight area is divided into 8 zones, and as illustrated in FIG. 6*a*, the 8 zones are powered respectively by two backlight power supply sources, so the 8 zones are divided into two backlight power supply zones; and as illustrated in FIG. 6*b*, the 8 zones are powered respectively by four backlight power supply sources, so the 8 zones are divided into four backlight power supply zones, so that each backlight power supply zones is powered by the same backlight power supply source.

Further to this, in this embodiment, the backlight data are zoned into the plurality of pieces of zone backlight data according to the distribution condition of the backlight power supply zones.

By way of an example, as illustrated in FIG. 6*a*, the backlight data are divided into two pieces of zone backlight data according to the distribution condition of the backlight power supply zones, where the first piece zone backlight data is located in the first backlight power supply zones powered by the first backlight power supply source, and the second piece zone backlight data is located in the second backlight power supply zones powered by the second backlight power supply source.

Accordingly the step 271 can include the following step:

The numbers of loads of the backlight source in the respective backlight power supply zones are calculated respectively according to the pieces of zone backlight data.

After the backlight data are divided into the pieces of zone backlight data according to the distribution condition of the backlight power supply zones, the numbers of loads of the backlight source in the respective backlight power supply zones are calculated respectively according to the pieces of zone backlight data, so that such driving control signals corresponding to the respective backlight power supply zones can be obtained that it can be determined separately for the respective backlight power supply zones whether to overvoltage-drive the backlight source.

With the process as described above, the backlight source can be subsequently driven and adjusted in brightness in the respective zones, so that the backlight source is driven and adjusted in brightness at different speeds respectively in the different backlight power supply zones, that is, the backlight source is driven and adjusted in brightness at a higher speed in some backlight power supply zone, and at a lower speed in another backlight power supply zone to thereby improve the contrast of a picture displayed on the liquid crystal panel so as to further improve the subjective visual experience of the user.

In an embodiment of the disclosure, the method as described above can further include the following step which can be performed by the backlight processing unit 131 in the apparatus 130 for adjusting backlight driving voltage:

A synchronization signal is received, and the respective pieces of zone backlight data are synchronized according to the synchronization signal.

As illustrated in FIG. 6*a* or FIG. 6*b*, the backlight area is divided into 8 zones, and accordingly the backlight data received by the backlight processing unit 131 are actually divided into 8 pieces of zone backlight data. Thus the image processing apparatus 110 typically generates the synchronization signal to synchronize these zone backlight data, and identifies the different pieces of zone backlight data using the synchronization signal.

As illustrated in FIG. 6*c*, the synchronization signal SYNC is a pulse signal which is high-valid to represent a starting position of a piece of zone backlight data SPI.

Of course, in another application scenario, the synchronization signal can alternatively be low-valid to represent a starting position or an ending position of a piece of zone backlight data, or can identify the different zone backlight data using a string of numerals, for example, the synchronization signal of 1 represents the first piece of zone backlight data, the synchronization signal of 2 represents the second piece of zone backlight data, and so on, although this embodiment will not be limited thereto.

Since the 8 pieces of zone backlight data are further divided into the several pieces of zone backlight data according to the distribution condition of the backlight power supply zones, in this embodiment, the synchronization signal is received so that the several pieces of zone backlight data can be synchronization, that is, the several pieces of zone backlight data can be identified using the synchronization signal, so that the backlight processing unit 131 can obtain the respective pieces of zone backlight data precisely.

It shall be appreciated that the backlight data are received at such a frequency that is the scan frequency of the image signal, and the zone backlight data are configured to control the backlight source to be driven, and the brightness thereof, in the backlight power supply zones, so with the process as described above, the backlight source can be driven and adjusted in brightness in the backlight power supply zones in synchronization with the scan frequency of the image signal to thereby improve the accuracy of driving, and adjusting the brightness of, the backlight source.

Referring to FIG. 7, in an embodiment of this disclosure, the step 230 can include the following steps which can be performed by the backlight processing unit 131 in the apparatus 300 for adjusting backlight driving voltage:

The step 231 is to obtain the voltage adjustment value carried in the voltage feedback data.

Since the voltage feedback data is generated internal to the PWM driver 133, and overvoltage adjustment is made in the backlight processing unit 131, the backlight processing unit 131 can retrieve the voltage feedback data from the register in the PWM driver 133 by sending an instruction to the PWM driver 133 to retrieve it from the register, before overvoltage adjustment is made to the voltage feedback data.

Since the voltage feedback data carries the voltage adjustment value, the backlight processing unit 131 can obtain the voltage adjustment value in the voltage feedback data by extracting it from the voltage feedback data after retrieving the voltage feedback data.

The step 233 is to obtain the overvoltage adjustment value.

The overvoltage adjustment value is such a compensation value of additional compensation for the voltage feedback data that can be preset by the backlight processing unit 131, or generated dynamically by the backlight processing unit 131 according to the number of loads of the backlight source 150 to thereby improve the accuracy of overvoltage adjustment, where the number of loads of the backlight source 150 is calculated by the backlight processing unit 131 according to the received backlight data.

By way of an example, the overvoltage adjustment value is preset. Only one overvoltage adjustment value may be preset, that is, the overvoltage adjustment value will be applied throughout the overvoltage adjustment process, or a plurality of overvoltage adjustment values may be preset, so that one of the different overvoltage adjustment values will be selected for overvoltage adjustment according to the number of loads of the backlight source 150.

If two different overvoltage adjustment values are preset, then one of the overvoltage adjustment values will be selected by comparing the number of loads of the backlight source 150 with the preset number. If the number of loads of the backlight source 150 is changed to be more than the preset number, then larger one of the overvoltage adjustment values will be selected for overvoltage adjustment to the voltage adjustment value; and on the contrary, if the number of loads of the backlight source 150 is no more than the preset number, then smaller one of the overvoltage adjustment values will be selected for overvoltage adjustment to the voltage adjustment value.

The step 235 is to adjust the voltage adjustment value using the overvoltage adjustment value, and to generate the overvoltage feedback data according to the adjustment voltage adjustment value.

In this embodiment, overvoltage adjustment to the voltage adjustment value is made by the backlight processing unit 131 making additional compensation for the voltage adjustment value using the overvoltage adjustment value, so that the backlight driving voltage which has been adjusted using the overvoltage feedback data is higher than the backlight driving voltage which has been adjusted using the voltage feedback data.

After overvoltage adjustment to the voltage adjustment value is made, the overvoltage feedback data can be generated by carrying the data, that is, carrying the adjusted voltage adjustment value in the generated overvoltage feedback data.

With the process as described above, the backlight processing unit of the apparatus for adjusting backlight driving voltage can send the overvoltage feedback data to generate higher backlight driving voltage to thereby speed up dynamic adjustment to the backlight driving voltage so as to improve the response speed of the backlight of the liquid crystal TV set, and to further overvoltage-drive the backlight source using the higher backlight driving voltage to thereby enable overvoltage driving so as to enable the backlight source to be driven and adjusted in brightness rapidly, thus enabling the backlight to become brighter or darker rapidly to thereby improve the subjective visual experience of the user.

Furthermore, referring to FIG. 7*a*, in an embodiment of this disclosure, the step 233 can include the following steps which can be performed by the backlight processing unit 131 in the apparatus 130 for adjusting backlight driving voltage:

The step 2331 is to obtain the number of loads of the backlight source according to the received backlight data.

As described above, after the image processing apparatus 110 transmits the generated backlight data, the backlight processing unit 131 in the apparatus 130 for adjusting backlight driving voltage can receive the backlight data.

Furthermore since the backlight data are configured to control the backlight source 150 to produce the brightness agreeing with the image signal, it can reflect the brightness of the backlight source 150, where the limited brightness of each backlight lamp L is dependent upon rated power of the backlight lamp L. If the backlight data are very large, which indicates that the brightness of the backlight source 150 is very high, then the demand for the very high brightness of the backlight source 150 will need to be satisfied by increasing the number of backlight lamps L in the backlight source 150, for example, increasing the number of backlight lamps L connected in series as illustrated in FIG. 3.

Accordingly in this embodiment, the number of loads of the backlight source 150 will be calculated according to the backlight data.

The current brightness of the backlight source 150 is calculated from the backlight data, and the number of backlight lamps L corresponding to the current brightness, i.e., the number of loads of the backlight source 150, is calculated according to real brightness of each backlight lamp L, where the real brightness of the backlight lamp L is dependent upon the resistance of the backlight lamp L, and the reference driving current.

It shall be noted that in this embodiment, the backlight data can also be zoned into a plurality of pieces of zone backlight data according to a distribution condition of backlight power supply zones, so that the number of loads of the backlight source can be calculated from the pieces of zone backlight data, and since an implementation thereof is the same as described in the embodiments above, a repeated description thereof will be omitted here.

The step 2333 is to generate the overvoltage adjustment value according to the number of loads of the backlight source.

In this embodiment, the overvoltage adjustment value is generated dynamically according to the number of loads of the backlight source 150, that is, the number of loads of the backlight source 150 is converted proportionally into the overvoltage adjustment value.

For example, if the number of loads of the backlight source is increased by 100, then the overvoltage adjustment value will be doubled.

With the process as described above, the overvoltage adjustment value can be generated dynamically according to the number of loads of the backlight source, so that if there are a larger number of loads of the backlight source, then the overvoltage adjustment value will be also larger, and accordingly the backlight driving voltage will be adjusted more rapidly, thus improving the accuracy of adjusting the backlight driving voltage.

FIG. 8 is a schematic diagram of an implementation of the method for adjusting backlight driving voltage in an application scenario. As illustrated in FIG. 8, the DC/DC converter 135 is powered by only one backlight power supply source (a power source input) of the backlight source 150, thus resulting in a backlight power supply zone.

In the backlight power supply zone, the backlight lamps in the backlight source 150 are connected in series and in parallel. Stated otherwise, in the backlight power supply zone, the backlight source 150 includes two branches of backlight lamps, both of which are connected in parallel, where there is a plurality of backlight lamps connected in series in each branch.

Moreover the data feedback loop 139 runs between the DC/DC converter 135 and the PWM driver 133, so that the overvoltage feedback data are subsequently transmitted between the DC/DC converter 135 and the PWM driver 133.

FIG. 9 is a schematic diagram of an implementation of the method for adjusting backlight driving voltage in another application scenario, where the internal structure of the PWM driver 133, and the switch element (the field effect transistor), and the sample resistor are not illustrated.

As illustrated in FIG. 9, the DC/DC converter 135 is powered by two backlight power supply sources (a power source input 1 and a power source input 2) of the backlight source 150, thus resulting in two backlight power supply zones.

In each backlight power supply zone, the backlight lamps in the backlight source 150 are connected in series and in parallel. Stated otherwise, in each backlight power supply zone, the backlight source 150 includes two branches of backlight lamps, both of which are connected in parallel, where there is a plurality of backlight lamps connected in series in each branch.

Moreover the data feedback loop 139 runs between the backlight processing unit 131 and each DC/DC converter 135, so that the overvoltage feedback data or the voltage feedback data are subsequently transmitted between the backlight processing unit 131 and the DC/DC converter 135.

Now the method for adjusting backlight driving voltage according to an embodiment of this disclosure will be described below in connection with the application scenarios illustrated in FIG. 8 and FIG. 9 taking the liquid crystal TV set illustrated in FIG. 2 and FIG. 3*b*.

The backlight processing unit 131 receives the synchronization signal and the backlight data, and then maps the backlight data into the duty ratio data, so that the PWM driver 133 generates the pulse width modulation signal $PWM_1$ according to the duty ratio to control the field effect transistor to be switched on/off, and compares the backlight driving current with the reference driving current to generate the voltage feedback data.

On one hand, for example, if the driving control signal is invalid, then the voltage feedback data will be feed by the PWM driver 133 back directly to the DC/DC driver 135 through the data feedback loop 139 (illustrated in FIG. 8), or can be firstly transmitted to the backlight processing unit 131, and then fed by the backlight processing unit 131 back to the DC/DC converter 135 through the data feedback loop 139 (illustrated in FIG. 9) to thereby adjust normally the backlight driving voltage output by the DC/DC converter 135, and to further drive normally the backlight source 150 by the adjusted backlight driving voltage.

On the other hand, for example, if the driving control signal is valid, or overvoltage adjustment is made by default in the liquid crystal TV set 100, then after the voltage feedback data are generated, the backlight processing unit 131 will further make overvoltage adjustment to the voltage feedback data to generate the overvoltage feedback data. In view of this, the backlight processing unit 131 firstly retrieves the voltage feedback data from the PWM driver 133 from the register, and then makes overvoltage adjustment to the voltage feedback data.

Furthermore the voltage feedback data can be feed by the backlight processing unit 131 back directly to the DC/DC driver 135 through the data feedback loop 139 (illustrated in FIG. 9), or can be firstly transmitted to the PWM driver 133, and then fed by the PWM driver 133 back to the DC/DC converter 135 through the data feedback loop 139 (illustrated in FIG. 9) to thereby make overvoltage adjustment to the backlight driving voltage output by the DC/DC converter 135, and to further overvoltage-drive the backlight source 150 by the adjusted backlight driving voltage.

In the embodiments of this disclosure, with the process as described above, overvoltage adjustment can be made to the voltage feedback data to generate the overvoltage feedback data, and the backlight driving voltage can be further adjusted using the overvoltage feedback data, so that overvoltage adjustment is made so that the backlight driving voltage can be adjusted rapidly from lower voltage to higher voltage, that is, the backlight driving voltage can climb up at a slope approaching ideal 90° as illustrated in FIG. 10 to thereby improve the response speed of the backlight in the liquid crystal TV set so as to drive and adjust in brightness the backlight source rapidly, thus improving the subjective visual experience of the user.

Moreover if the driving control signal is invalid, then no overvoltage adjustment will be made to the voltage feedback data, but the backlight driving voltage will be adjusted normally using the voltage feedback data directly, thus shortening in effect the period of time for adjusting the backlight driving voltage to thereby improve the efficiency of adjusting and driving the backlight driving voltage.

An apparatus according to embodiments of this disclosure, which can perform the method for adjusting backlight driving voltage according to this disclosure will be described below. For details which are not disclosed in the apparatus embodiments of this disclosure, reference can be made to the embodiments of the method for adjusting backlight driving voltage according to this disclosure.

Referring to FIG. 11, in an embodiment of this disclosure, an apparatus 500 for adjusting backlight driving voltage can include but will not be limited to a voltage feedback data obtaining unit 510, an overvoltage feedback data generating unit 530, and an overvoltage adjusting unit 550. In an implementation, the voltage feedback data obtaining unit 510 and the overvoltage feedback data generating unit 530 can be the backlight processing unit 131 as illustrated in FIG. 3*b*, FIG. 8, or FIG. 9, and the overvoltage adjusting unit 550 can be the PWM driver 133 and the DC/DC converter 135 as illustrated in FIG. 3*b*, FIG. 8, or FIG. 9.

Here the voltage feedback data obtaining unit 510 is configured to compare backlight driving current with reference driving current to obtain voltage feedback data, while a backlight source is being driven.

The overvoltage feedback data generating unit 530 is configured to make overvoltage adjustment to the voltage feedback data to generate overvoltage feedback data.

The overvoltage adjusting unit 550 is configured to adjust backlight driving voltage using the overvoltage feedback data to overvoltage-drive the backlight source by the adjusted backlight driving voltage.

Referring to FIG. 12, in an embodiment of this disclosure, the apparatus 500 as described above can further include but will not be limited to a driving control signal obtaining unit 570 and a normally adjusting unit 590. In an implementation, the driving control signal obtaining unit 570 can be embodied in the backlight processing unit 131 as illustrated in FIG. 3*b*, FIG. 8, or FIG. 9, and the normally adjusting unit 590 can be the DC/DC converter 135 as illustrated in FIG. 3*b*, FIG. 8, or FIG. 9.

Here the driving control signal obtaining unit 570 is configured to obtain a driving control signal, to determine whether the driving control signal is valid, and if so, to notify the overvoltage feedback data generating unit 530; otherwise, to notify the normally adjusting unit 590.

The normally adjusting unit 590 is configured to adjust the backlight driving voltage using the voltage feedback data to drive normally the backlight source by the adjusted backlight driving voltage.

Referring to FIG. 13, in an embodiment of this disclosure, the driving control signal obtaining unit 570 can include but will not be limited to a number of loads obtaining unit 571 and a number of loads comparing module 573.

Here the number of loads obtaining unit 571 is configured to obtain the number of loads of the backlight source according to received backlight data.

The number of loads comparing module 573 is configured to compare the number of loads of the backlight source with a preset number, and to generate the driving control signal according to a comparison result.

In an embodiment of this disclosure, the apparatus 500 as described can include but will not be limited to a zoning unit. In an implementation, the zoning unit can be embodied in the backlight processing unit 131.

Here the zoning unit is configured to zone the backlight data into a plurality of pieces of zone backlight data according to a distribution condition of backlight power supply zones.

Accordingly the number of loads obtaining module 511 can include but will not be limited to a number of loads calculating module.

Here the number of loads calculating module is configured to calculate the numbers of loads of the backlight source in the respective backlight power supply zones respectively according to the pieces of zone backlight data.

In an embodiment of this disclosure, the apparatus 500 as described can further include but will not be limited to a synchronization signal receiving unit. In an implementation, the synchronization signal receiving unit can be embodied in the backlight processing unit 131.

Here the synchronization signal receiving unit is configured to receive a synchronization signal, and to synchronize the respective zone backlight data using the synchronization signal.

Referring to FIG. 14, in an embodiment of this disclosure, the overvoltage feedback data generating unit 530 can include but will not be limited to a voltage adjusting value obtaining module 531, an overvoltage adjustment value obtaining module 533, and an adjusting module 535.

Here the voltage adjusting value obtaining module 531 is configured to obtain a voltage adjustment value carried in the voltage feedback data.

The overvoltage adjustment value obtaining module 533 is configured to obtain an overvoltage adjustment value.

The adjusting module 535 is configured to adjust the voltage adjustment value using the overvoltage adjustment value, and to generate the overvoltage feedback data according to the adjusted voltage adjustment value.

Furthermore referring to FIG. 15, in an embodiment of this disclosure, the overvoltage adjustment value obtaining module 533 can include but will not be limited to a number of loads obtaining module 5331 and a number of loads converting module 5333.

Here the number of loads obtaining module 5331 is configured to obtain the number of loads of the backlight source according to received backlight data.

The number of loads converting module 5333 is configured to generate the overvoltage adjustment value according to the number of loads of the backlight source. It shall be noted that the apparatus for adjusting backlight driving voltage according to the embodiments above has been described merely by way of an example where the apparatus is divided into the respective functional modules configured to adjust the backlight driving voltage, but in a real application, the functions above can be allocated as needed to different functional modules for performance thereof, that is, the internal structure of the liquid crystal TV set can be divided into different functional modules to perform all or a part of the functions as described above.

Furthermore the underlying idea of the apparatus for adjusting backlight driving voltage according to the embodiments above is the same as the method for adjusting backlight driving voltage according to the embodiments above, and since particular implementations of the operations performed by the respective modules have been described in details in the embodiments of the method, a repeated description thereof will be omitted here.

The foregoing disclosure is merely illustrative of the preferred embodiments of this disclosure, but not to intend to limit the embodiments of this disclosure, and those ordinarily skilled in the art can make corresponding modifications or variations conveniently thereto without departing from the spirit of this disclosure, so the claimed scope of this disclosure shall be as defined in the appended claims.

The invention claimed is:

1. A method for adjusting backlight driving voltage, the method comprising:

comparing backlight driving current with reference driving current to obtain voltage feedback data, while a backlight source is being driven;

making overvoltage adjustment to the voltage feedback data to generate overvoltage feedback data; and adjusting backlight driving voltage using the overvoltage feedback data to overvoltage-drive the backlight source by the adjusted backlight driving voltage.

2. The method according to claim 1, wherein the method further comprises:

obtaining a driving control signal, and determining whether the driving control signal is valid;

if the driving control signal is invalid, then adjusting the backlight driving voltage using the voltage feedback data to drive normally the backlight source by the adjusted backlight driving voltage; and if the driving control signal is valid, then performing the process of making overvoltage adjustment to the voltage feedback data to generate the overvoltage feedback data.

3. The method according to claim 2, wherein the obtaining the driving control signal comprises:

obtaining the number of loads of the backlight source according to received backlight data; and comparing the number of loads of the backlight source with a preset number, and generating the driving control signal according to a comparison result.

4. The method according to claim 3, wherein the method further comprises:

zoning the backlight data into a plurality of pieces of zone backlight data according to a distribution condition of backlight power supply zones; and the obtaining the number of loads of the backlight source according to the received backlight data comprises:

calculating the numbers of loads of the backlight source in the respective backlight power supply zones respectively according to the pieces of zone backlight data.

5. The method according to claim 4, wherein the method further comprises:

receiving a synchronization signal, and synchronizing the respective zone backlight data using the synchronization signal.

6. The method according to claim 1, wherein the making overvoltage adjustment to the voltage feedback data to generate the overvoltage feedback data comprises:

obtaining a voltage adjustment value carried in the voltage feedback data;

obtaining an overvoltage adjustment value; and adjusting the voltage adjustment value using the overvoltage adjustment value, and generating the overvoltage feedback data according to the adjusted voltage adjustment value.

7. The method according to claim 6, wherein the obtaining the overvoltage adjustment value comprises:

obtaining the number of loads of the backlight source according to received backlight data; and generating the overvoltage adjustment value according to the number of loads of the backlight source.

8. An apparatus for adjusting backlight driving voltage, the apparatus comprising:

a memory configured to store at least one machine readable program code; and a processor configured to execute the at least one machine readable program code to perform:

comparing backlight driving current with reference driving current to obtain voltage feedback data, while a backlight source is being driven; and making overvoltage adjustment to the voltage feedback data to generate overvoltage feedback data; and a voltage adjusting section configured to adjust backlight driving voltage using the overvoltage feedback data from the processor to overvoltage-drive the backlight source by the adjusted backlight driving voltage.

9. The apparatus according to claim 8, wherein the processor is further configured to execute the at least one machine readable program code to perform:

obtaining a driving control signal, and determining whether the driving control signal is valid;

if the driving control signal is invalid, then adjusting the backlight driving voltage using the voltage feedback data to obtain the adjusted backlight driving voltage, so that the voltage adjusting section drives normally the backlight source by the adjusted backlight driving voltage; and if the driving control signal is valid, then performing the process of making overvoltage adjustment to the voltage feedback data to generate the overvoltage feedback data.

10. The apparatus according to claim 9, wherein the processor configured to execute the at least one machine readable program code to perform obtaining the driving control signal is configured to perform:

obtaining the number of loads of the backlight source according to received backlight data; and comparing the number of loads of the backlight source with a preset number, and generating the driving control signal according to a comparison result.

11. The apparatus according to claim 10, wherein the processor is configured to execute the at least one machine readable program code to further perform:

zoning the backlight data into a plurality of pieces of zone backlight data according to a distribution condition of backlight power supply zones; and the processor configured to execute the at least one machine readable program code to perform obtaining the number of loads of the backlight source according to the received backlight data is configured to perform:

calculating the numbers of loads of the backlight source in the respective backlight power supply zones respectively according to the pieces of zone backlight data.

12. The apparatus according to claim 11, wherein the processor is configured to execute the at least one machine readable program code to further perform:

receiving a synchronization signal, and synchronizing the respective zone backlight data using the synchronization signal.

13. The apparatus according to claim 8, wherein the processor configured to execute the at least one machine readable program code to perform making overvoltage adjustment to the voltage feedback data to generate the overvoltage feedback data is configured to perform:

obtaining a voltage adjustment value carried in the voltage feedback data;

obtaining an overvoltage adjustment value; and adjusting the voltage adjustment value using the overvoltage adjustment value, and generating the overvoltage feedback data according to the adjusted voltage adjustment value.

14. The apparatus according to claim 13, wherein the processor configured to execute the at least one machine readable program code to perform obtaining the overvoltage adjustment value is configured to perform:

obtaining the number of loads of the backlight source according to received backlight data; and generating the overvoltage adjustment value according to the number of loads of the backlight source.

15. A liquid crystal TV set, comprising an image processing apparatus and a backlight source, and further an apparatus for adjusting backlight driving voltage, wherein:

the image processing apparatus is configured to transmit generated backlight data to the apparatus for adjusting backlight driving voltage; and the apparatus for adjusting backlight driving voltage is configured to compare backlight driving current with reference driving current to obtain voltage feedback data, while a backlight source is being driven; to make overvoltage adjustment to the voltage feedback data to generate overvoltage feedback data; and to adjust backlight driving voltage using the overvoltage feedback data to overvoltage-drive the backlight source by the adjusted backlight driving voltage.

16. The liquid crystal TV set according to claim 15, wherein the apparatus for adjusting backlight driving voltage is further configured:

to obtain a driving control signal, and to determine whether the driving control signal is valid;

if the driving control signal is invalid, to adjust the backlight driving voltage using the voltage feedback data to drive normally the backlight source by the adjusted backlight driving voltage; and if the driving control signal is valid, to perform the process of making overvoltage adjustment to the voltage feedback data to generate the overvoltage feedback data.

17. The liquid crystal TV set according to claim 16, wherein the apparatus for adjusting backlight driving voltage configured to obtain the driving control signal is configured:

to obtain the number of loads of the backlight source according to received backlight data; and to compare the number of loads of the backlight source with a preset number, and to generate the driving control signal according to a comparison result.

18. The liquid crystal TV set according to claim 17, wherein the apparatus for adjusting backlight driving voltage is further configured:

to zone the backlight data into a plurality of pieces of zone backlight data according to a distribution condition of backlight power supply zones; and the apparatus for adjusting backlight driving voltage configured to obtain the number of loads of the backlight source according to the received backlight data comprises:

to calculate the numbers of loads of the backlight source in the respective backlight power supply zones respectively according to the pieces of zone backlight data.

19. The liquid crystal TV set according to claim 15, wherein the apparatus for adjusting backlight driving voltage configured to make overvoltage adjustment to the voltage feedback data to generate the overvoltage feedback data is configured:

to obtain a voltage adjustment value carried in the voltage feedback data;

to obtain an overvoltage adjustment value; and to adjust the voltage adjustment value using the overvoltage adjustment value, and to generate the overvoltage feedback data according to the adjusted voltage adjustment value.

20. The liquid crystal TV set according to claim 19, wherein the apparatus for adjusting backlight driving voltage configured to obtain the overvoltage adjustment value is configured:

to obtain the number of loads of the backlight source according to received backlight data; and to generate the overvoltage adjustment value according to the number of loads of the backlight source.

* * * * *